US006114809A

United States Patent [19]

Winsor

[11] Patent Number: 6,114,809

[45] Date of Patent: Sep. 5, 2000

[54] PLANAR FLUORESCENT LAMP WITH STARTER AND HEATER CIRCUIT

[75] Inventor: Mark D. Winsor, Seattle, Wash.

[73] Assignee: Winsor Corporation, Tumwater, Wash.

[21] Appl. No.: 09/017,256

[22] Filed: Feb. 2, 1998

[51] Int. Cl.[7] ..... H01J 7/44

[52] U.S. Cl. ..... 315/50; 315/60; 315/97; 315/49; 313/493; 313/634

[58] Field of Search ..... 315/50, 56, 60, 315/94, 97, 98, 169.1, 49, 115; 313/493, 494, 491, 600, 609, 613, 634

[56] References Cited

U.S. PATENT DOCUMENTS

| | | | |
|---|---|---|---|
| 1,984,215 | 12/1934 | Hotchner | 176/14 |
| 2,255,431 | 9/1941 | Marden et al. | 176/122 |
| 2,405,518 | 8/1946 | Polevitzky | 176/122 |
| 2,555,749 | 6/1951 | Krefft | 313/109 |
| 2,733,368 | 1/1956 | Kolkman | 313/109 |
| 2,774,918 | 12/1956 | Lemmers | 315/98 |
| 2,900,545 | 8/1959 | Rulon et al. | 313/108 |

(List continued on next page.)

FOREIGN PATENT DOCUMENTS

| | | |
|---|---|---|
| 0 066 495 A2 | 12/1982 | European Pat. Off. . |
| 0 329 226 A1 | 8/1989 | European Pat. Off. . |
| 0 550 047 A2 | 7/1993 | European Pat. Off. . |
| 89 04 853 | 8/1989 | Germany . |
| 39 22 865 A1 | 1/1991 | Germany . |
| 43 13 017 A1 | 12/1994 | Germany . |
| 60-216435 | 10/1985 | Japan . |
| 62-208536 | 9/1987 | Japan . |
| 1017374 | 1/1989 | Japan . |
| 64-17374 | 1/1989 | Japan . |
| 1206553 | 8/1989 | Japan . |
| 2-72552 | 3/1990 | Japan . |
| 2-78147 | 3/1990 | Japan . |
| 3-46748 | 2/1991 | Japan . |
| 3-129659 | 6/1991 | Japan . |
| 3-222253 | 10/1991 | Japan . |
| 3-285249 | 12/1991 | Japan . |
| 4-95337 | 3/1992 | Japan . |
| 4-147554 | 5/1992 | Japan . |
| 06251876 | 9/1994 | Japan . |
| 947340 | 1/1964 | United Kingdom . |
| 2 032 681 | 5/1980 | United Kingdom . |
| 2 217 515 | 10/1989 | United Kingdom . |
| WO 87/04562 | 7/1987 | WIPO . |
| WO 92/02947 | 2/1992 | WIPO . |

OTHER PUBLICATIONS

Mercer et al., "Fluorescent backlights for LCDs," *Information Display*: 8–13, Nov. 1989.

Sanyo Electric Co., Ltd., "Flat Fluorescent Lamp Specifications."

Hinotani et al., "Flat Fluorescent Lamp for LCD Back–Light," *1988 International Display Research Conference*.

*Primary Examiner*—Haissa Philogene

*Attorney, Agent, or Firm*—Michael J. Donohue; Seed IP Law Group PLLC

[57] ABSTRACT

A planar fluorescent lamp having a resistive trace and optically transmissive cover electrodes is described. In one embodiment, the lamp includes an insulative lamp body with the transparent cover electrodes supported by the lamp cover. The resistive trace is supported by the base, either as an exterior resistive trace or within the lamp. The resistive trace acts as a heating element by producing heat in response to an electric current passed through the resistive trace. Because the resistive trace is in thermal contact with the lamp body, heat produced by the resistive trace heats the lamp, improving cold starting. The cover electrodes and, in some embodiments, the resistive trace, are used to control electric fields within the lamp body by applying voltage potentials between discrete cover electrodes or between the cover electrodes and the resistive trace. The controllable electric fields improve cold starting and uniformity of light during low light operation. In an alternative embodiment, the lamp includes an insulatively coated metal lamp body with a glass cover soldered thereto. In another alternative embodiment, the lamp includes two lamp covers with a fluorescent material sandwiched therebetween.

29 Claims, 3 Drawing Sheets

U.S. PATENT DOCUMENTS

| | | | |
|---|---|---|---|
| 3,047,763 | 7/1962 | Inman | 313/109 |
| 3,103,607 | 9/1963 | Rulon | 313/108 |
| 3,121,184 | 2/1964 | Fox | 313/207 |
| 3,198,943 | 8/1965 | Pistey | 240/51.11 |
| 3,226,590 | 12/1965 | Christy | 313/109 |
| 3,253,176 | 5/1966 | Pate et al. | 313/204 |
| 3,258,630 | 6/1966 | Scott | 313/109 |
| 3,313,652 | 4/1967 | Blazek et al. | 117/215 |
| 3,508,103 | 4/1970 | Young | 313/109 |
| 3,646,383 | 2/1972 | Jones et al. | 313/109 |
| 3,967,153 | 6/1976 | Milke et al. | 313/489 |
| 4,079,288 | 3/1978 | Maloney et al. | 313/489 |
| 4,117,374 | 9/1978 | Witting | 315/99 |
| 4,234,817 | 11/1980 | Teshima et al. | 313/493 |
| 4,245,179 | 1/1981 | Buhrer | 315/248 |
| 4,312,028 | 1/1982 | Hamacher | 362/369 |
| 4,363,998 | 12/1982 | Graff et al. | 313/487 |
| 4,482,580 | 11/1984 | Emmett et al. | 427/66 |
| 4,698,547 | 10/1987 | Grossman et al. | 313/485 |
| 4,710,679 | 12/1987 | Budinger et al. | 315/58 |
| 4,743,799 | 5/1988 | Loy | 313/493 |
| 4,767,965 | 8/1988 | Yamano et al. | 313/491 |
| 4,772,819 | 9/1988 | Ridders | 313/493 |
| 4,803,399 | 2/1989 | Ogawa et al. | 313/493 |
| 4,837,519 | 6/1989 | Lopetrone et al. | 324/529 |
| 4,839,555 | 6/1989 | O'Mahoney | 313/493 |
| 4,851,734 | 7/1989 | Hamai et al. | 313/485 |
| 4,899,080 | 2/1990 | Vriens et al. | 313/477 |
| 4,916,352 | 4/1990 | Haim et al. | 313/25 |
| 4,916,356 | 4/1990 | Ahern et al. | 313/336 |
| 4,916,359 | 4/1990 | Jönsson | 313/489 |
| 4,920,298 | 4/1990 | Hinotani et al. | 313/493 |
| 4,924,143 | 5/1990 | Imamura et al. | 313/493 |
| 4,983,881 | 1/1991 | Eliasson et al. | 313/607 |
| 5,051,648 | 9/1991 | Misono et al. | 313/13 |
| 5,066,257 | 11/1991 | Farner et al. | 445/26 |
| 5,143,433 | 9/1992 | Farrell | 362/29 |
| 5,211,463 | 5/1993 | Kalmanash | 362/26 |
| 5,220,249 | 6/1993 | Tsukada | 315/246 |
| 5,237,641 | 8/1993 | Jacobson et al. | 385/146 |
| 5,253,151 | 10/1993 | Mepham et al. | 362/216 |
| 5,319,282 | 6/1994 | Winsor | 315/169.4 |
| 5,343,116 | 8/1994 | Winsor | 313/493 |
| 5,420,481 | 5/1995 | McCanney | 315/291 |
| 5,442,522 | 8/1995 | Kalmanash | 362/26 |
| 5,463,274 | 10/1995 | Winsor | 313/493 |
| 5,466,990 | 11/1995 | Winsor | 315/56 |
| 5,479,069 | 12/1995 | Winsor | 313/493 |
| 5,479,071 | 12/1995 | Lynn | 313/514 |
| 5,509,841 | 4/1996 | Winsor | 445/26 |
| 5,536,999 | 7/1996 | Winsor | 313/493 |
| 5,616,989 | 4/1997 | Taillie et al. | 315/32 |
| 5,645,337 | 7/1997 | Gleckman | 362/29 |
| 5,818,164 | 10/1998 | Winsor | 313/493 |
| 5,841,230 | 11/1998 | Ikoma et al. | 313/506 |
| 5,850,122 | 12/1998 | Winsor | 313/493 |
| 5,903,095 | 5/1999 | Yoshida et al. | 313/485 |
| 5,903,096 | 5/1999 | Winsor | 313/493 |
| 5,914,560 | 6/1999 | Winsor | 313/493 |

PLANAR FLUORESCENT LAMP WITH STARTER AND HEATER CIRCUIT

TECHNICAL FIELD

The present invention relates to fluorescent lamps and, more particularly, to electrode and heater structures for planar fluorescent lamps.

BACKGROUND OF THE INVENTION

Planar fluorescent lamps are useful in many applications, including backlit displays and heads-up displays in aerospace applications.

Such lamps typically include a body having a chamber and one or more transparent faces from which light is emitted. Within the chamber, a gas containing mercury vapor produces ultraviolet energy in response to an electrical discharge provided by a spaced-apart pair of electrodes within the chamber. A fluorescent coating within the chamber converts the ultraviolet energy to visible energy, and the visible light is emitted through the transparent face to provide illumination. To extend the length across which the discharge will travel and thereby improve the efficiency of the lamp, an indirect path, such as a spiral or serpentine path, may be defined within the chamber by barrier walls.

While such lamps can provide excellent illumination during operation, they are often difficult to start and operate at low temperatures and/or low light levels. The principal cause of cold starting difficulty in low temperature environments is condensation of the mercury vapor within the lamp. In low temperature applications, the difficulty in starting lamps may be overcome to some extent by heating the lamp or by providing a heated environment in which the lamp is contained. Such an approach usually requires an external source of heat to be applied.

In low light and/or low temperature applications, uniformity of the discharge between the electrodes can be degraded, causing the light produced by the lamp to lack uniformity. For example, where the electrical excitation of the electrodes is insufficient to overcome cold starting conditions, it is difficult to generate a substantial discharge along the entire discharge path; consequently, dark areas can remain along the discharge path, causing the light emitted by the lamp to be uneven. Often, little or no light is emitted from the sections of the discharge path most distant from the electrodes.

SUMMARY OF THE INVENTION

A planar fluorescent lamp includes a lamp body having a base and sidewalls defining a cavity, with the base having an exterior surface electrically insulated from the cavity. A lamp cover is supported by the lamp body, with the base, sidewalls, and cover defining a chamber. First and second electrodes are spaced apart within the chamber and form energy inputs for providing an electrical discharge along a discharge channel defined by a plurality of channel walls within the channels.

A gas within the chamber produces ultraviolet energy in response to the electrical discharge. A fluorescent material within the chamber emits visible light in response to the ultraviolet light.

An elongated first resistive heating element formed by a resistive trace is bonded to the exterior surface of the base in thermal contact with the chamber to provide heat to the chamber, with a portion of the first heating element substantially parallel to a corresponding portion of the discharge channel. The lamp also includes a second heating element substantially parallel to a second portion of the discharge channel to provide separate heat control to different portions of the chamber. The lamp also includes a pair of heating energy input terminals electrically connected to opposite ends of the first heating element for providing electrical energy to the first heating element. An additional terminal is connected to the resistive trace, such that the resistive trace can be referenced a voltage different from the voltage within the chamber, to produce an electrical field within the chamber.

A third heating element is supported by the lamp cover and substantially parallels the first portion of the discharge channel. The third heating element is a transparent, conductive film supported by the cover, with a layer of insulative material such as indium tin oxide overlaying the transparent conductive film to provide an insulative barrier from the chamber. First and second terminals are connected to the optically transmissive electrode for electrical connection to a supply voltage. The first and second electrodes are positioned to produce a desired electric field within the chamber when the a voltage is applied between the traces. A third terminal electrically connected to the first resistive trace supplies a current to the first trace separately from the voltage between the first and second traces, such that the first trace is heated to provide heat to the chamber.

In an alternative embodiment, the resistive trace is within the chamber, and the lamp includes a layer of insulative material overlaying the resistive trace, providing an insulative barrier between the chamber and the resistive trace. The electrically insulative layer overlaying the resistive trace is an optically transmissive layer in one embodiment and in an alternative embodiment, the electrically insulative layer is an optically reflective layer.

In another embodiment, the lamp includes a secondary cover overlaying the lamp cover, with a fluorescent material intermediate the lamp cover and the secondary lamp cover.

In an alternative embodiment, a plurality of electrically conductive, optically transmissive traces are supported by the cover. First, second, and third conductive traces are oriented to generate an electrical field within the chamber, with the electrical field intersecting the discharge channel. The second conductive trace is positioned intermediate a portion of the first trace and a portion of the third conductive trace, forming an interdigitated electrode. The first and third conductive traces are connected to a first buss along a first edge of the cover. The second conductive trace is connected to a second buss along a second edge of the cover.

DETAILED DESCRIPTION OF THE INVENTION

Figure 1:
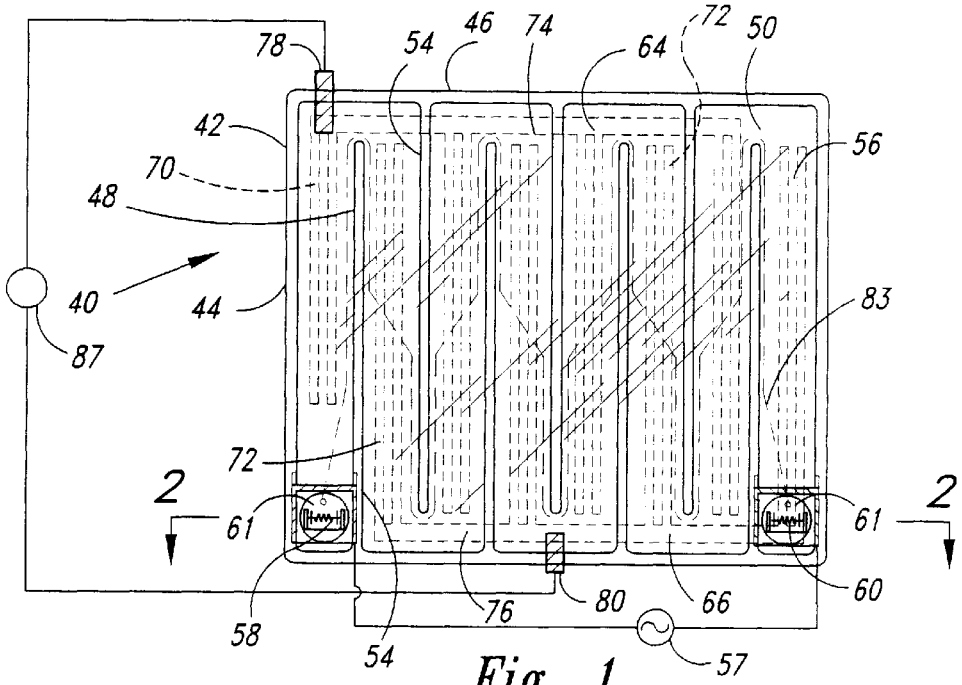
FIG. 1 is a top plan view of a planar fluorescent lamp having interdigitated optically transmissive electrodes on an inner surface of the lamp cover.
Figure 2:
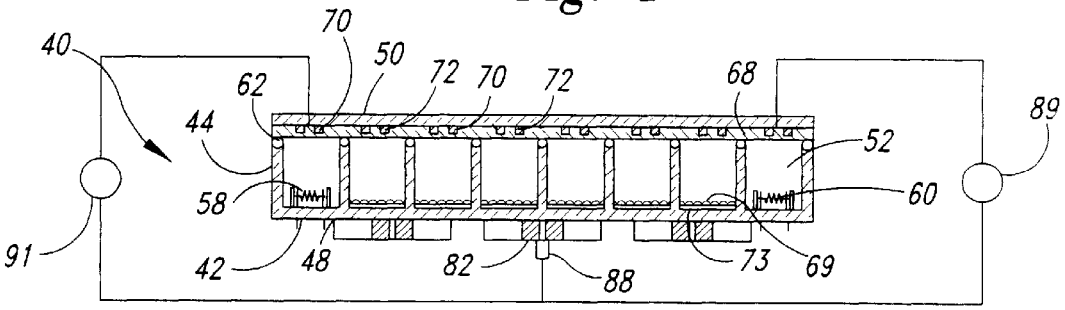
FIG. 2 is a side cross-sectional view of the lamp of FIG. 1 cross-sectioned along line 2—2.
Figure 3:
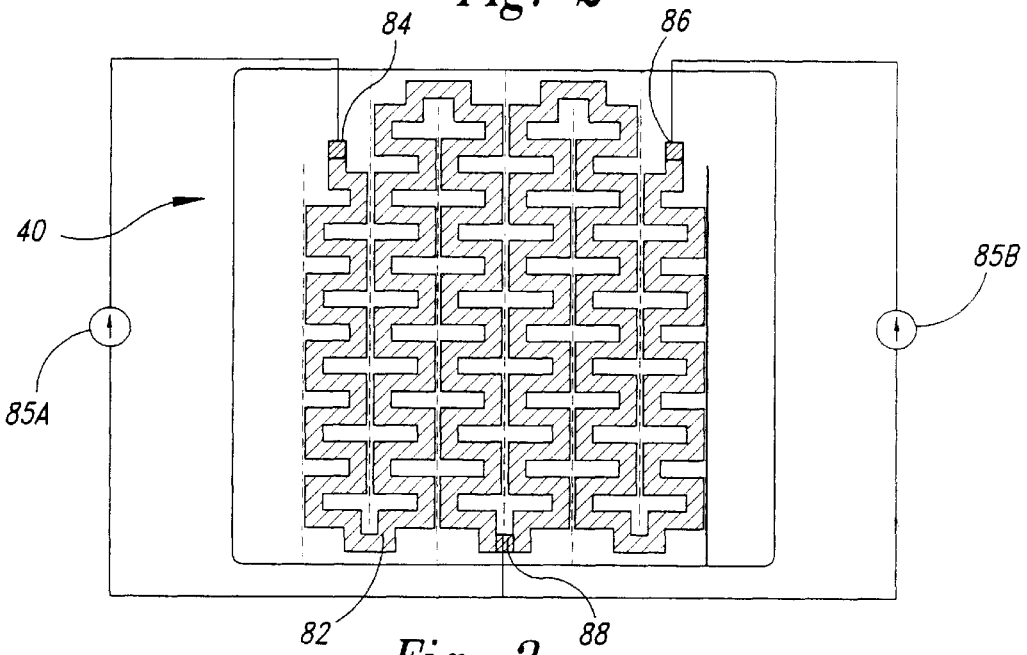
FIG. 3 is a bottom plan view of the lamp of FIG. 1 showing a resistive heating element bonded to the base of the lamp.

As shown in FIGS. 1, 2 and 3, a planar fluorescent lamp 40 includes a substantially rectangular lamp body 42 having sidewalls 44 and endwalls 46 projecting upwardly from a base 48. A lamp cover 50 overlays the lamp body 42 forming a chamber 52. A plurality of channel walls 54 project upwardly from the base 48 toward the cover 50 and project from each of the endwalls 46 toward opposite endwalls 46, ending a short distance from the opposite endwalls 46. As can best be seen from the view of FIG. 1, the sidewalls 44, endwalls 46, and channel walls 54 define a serpentine channel 56 within the chamber 52.

The base 48, endwalls 46, sidewalls 44, and channel walls 54 are formed integrally from glass. The cover 50 is formed from an optically transmissive glass selected to have a thermal coefficient of expansion matched to that of the lamp body 42 so that stresses on the lamp 40 due to thermally-induced expansion and contraction will be minimized.

A pair of electrodes 58, 60 are positioned at opposite ends of the serpentine channel 56. The electrodes 58, 60 are mounted within the chamber 52 by glass seals 61 which are bonded to the base 48 to seal the chamber 52. The leads of the electrodes 58, 60 (FIG. 2) extend through the glass seals 61 to permit electrical power to be applied to the electrodes 58, 60 by a power source 57 to produce an electrical plasma arc discharge between the electrodes 58, 60. Because the sidewalls 44 are insulative, the electrical discharge will follow a discharge path along the serpentine channel 56.

As best seen in the cross-section of FIG. 2, the lamp cover 50 is bonded to the upper edges of the sidewalls 44, endwalls 46, and channel walls 54 by a glass solder bead 62 which forms an airtight seal between the sidewalls 44 and the lamp cover 50 and between the endwalls 46 and the lamp cover 50. Together with the glass seals 61 holding the electrodes 58, 60, the seal formed by the glass solder bead 62 causes the chamber 52 to be airtight.

The sealed chamber 52 contains mercury vapor in a noble gas environment. As is known, the mercury vapor will emit ultraviolet light when the electrodes 58, 60 are energized to cause the electrical discharge to pass along the discharge path. A layer of fluorescent material 69 is deposited within the lamp 40 and generates visible light in response to the ultraviolet light from the mercury vapor.

The glass solder bead 62 also forms a continuous insulative barrier between the channel walls 54 and the cover 50 to force the electrical discharge between the electrodes 58, 60 to travel along the entire length of the serpentine channel 56. As is known, if an inadequate insulative barrier is placed between adjacent sections of the serpentine channel 56, the electrical discharge will pass between the cover 50 and the channel wall 54 rather than traveling along the entire length of the serpentine channel 56. This reduces the effective discharge length, thereby reducing the efficiency of the lamp 40. Moreover, because the electrical discharge would not travel throughout the entire serpentine channel 56, regions of the serpentine channel 56 would not generate ultraviolet energy and the resultant visible light, leaving dark regions in the lamp 40. Thus, the uniformity of light produced by the lamp 40 would be reduced. Because the glass solder bead 62 forms a continuous barrier, such shortcutting is prevented.

A reflective layer 73 overlays the base 48 beneath the fluorescent material 69. The reflective layer 73 reflects light outwardly through the cover 50 such that substantially all of the light produced in the lamp 40 is emitted through the cover 50. The reflective layer 73 is preferably a white porcelain enamel having a thermal coefficient of expansion selected to match that of the glass of the lamp body 42.

A pair of optically transmissive cover electrodes 64, 66 are supported within the chamber 52 by the cover 50. The cover electrodes 64, 66 are made of an optically transmissive, conductive film, such as an indium tin oxide layer. An insulative coating 68 overlays the cover electrodes 64, 66 to provide an insulative barrier between the electrodes 64, 66 and the chamber 52. In this embodiment, the insulative coating 68 is a titanium oxide coating. The thicknesses of the cover electrodes 64, 66 and insulative coating 68 are shown in exaggerated scale in the cross section of FIG. 2 for clarity of presentation.

As can best be seen in FIG. 1, the electrodes 64, 66 are formed in an interdigitated pattern with sections of each of the first electrode 64 and second electrode 66 oriented parallel to adjacent sections of the serpentine channel 56. The indium tin oxide of the electrodes 64, 66 is patterned to form the interdigitated pattern by typical photolithography or masking techniques. To create the interdigitated structure, each of the first and second cover electrodes 64, 66 includes respective bifurcated fingers 70, 72 with the fingers of each of the cover electrodes 64, 66 being electrically interconnected by respective edge busses 74, 76. To provide electrical connection to the respective electrodes 64, 66, respective terminals 78, 80, which are electrically connected to the respective busses 74, 76, are exposed at opposite edges of the cover 50.

In addition to the cover electrodes 64, 66, the lamp 40 includes a resistive trace 82 along an exterior surface of the base 48. The resistive trace 82 is formed by a patterned thick film resistive material, such as a 50Ω/* CERMET paste screened onto the exterior surface of the base 48. At each end of the resistive trace 82 are respective current inputs 84, 86 supplied by respective current sources 85A, 85B. At approximately the center of the resistive trace is a third terminal 88. The use of the two input terminals 84, 86 with the third terminal 88 therebetween allows each half of the resistive trace 82 to be selectively driven by a respective current. As is known, when a current is applied to the resistive trace 82, resistive heating occurs. Because the resistive trace 82 is in thermal contact with the base 48, heat energy from the resistive trace 82 is transferred to the base 48 and into the chamber 52, warming the chamber 52. As is known, heating of the chamber improves cold starting of the lamp 40 by reducing condensation of the mercury vapor within the chamber 52. The trace 82 follows a zigzag path to increase its effective length for increased heat and to distribute heat laterally across each of the channel sections. This more evenly heats the lamp 40 reducing "cold spots" that might otherwise make cold-starting more difficult.

In addition to providing access for connection of a current source, the third terminal 88 also permits a voltage to be applied to the resistive trace 82 relative to the voltage of one or both of the cover electrodes 64, 66. As discussed hereinafter, controlling the voltage of the resistive trace 82 relative to the cover electrodes 64, 66 and/or electrodes 58, 60 permits control of electric fields within the chamber 52.

In operation, the lamp 40 is energized by applying an AC voltage to the first and second electrodes 58, 60 to generate the electrical discharge through the mercury vapor in the noble gas environment within the chamber 52. To improve the cold starting of the lamp 40, electrical current is supplied between the third terminal and the current input terminals 84, 86 using the current sources 85A, 85B. Current flow between the third terminal 88 and the first current input terminal 84 heats the left half (as viewed in FIG. 3) of the lamp 40 and current between the third terminal 88 and the second current input terminal 86 heats the remainder of the lamp 40. The current through the resistive trace 82 can be either DC current or AC current at a frequency selected to minimize effects on the electrical discharge through the mercury vapor.

A voltage, represented by the power supply 87 in FIG. 1, is applied between the terminals 78, 80 to generate an electric field between the fingers 70 of the first cover electrode 64 and adjacent fingers 72 of the second cover electrode 66. The power supply 87 may be either a DC or AC source. As is known, a voltage differential between the fingers 70 and 72 will generate an electric field which extends into the chamber 52. By adjusting the magnitude and/or the frequency of the voltage between the terminals 78, 80 appropriately, the electric field between the fingers 70, 72 can be adjusted. The electric field thus produced affects the electrical discharge between the electrodes 58, 60 and can improve the uniformity and efficiency of the discharge. In particular, at lower voltages, the discharges between the electrodes 58, 60 tends to "hug" the channel walls 54 as it travels through the serpentine channel 56, as indicated by the broken line 83 (FIG. 1). The electric fields within the chamber 52 generated by the voltage applied to the fingers 70, 72 cause the discharge to move away from the channel walls 54 toward the center of the serpentine channel. Bifurcation of the fingers 70, 72 allows the fingers 70, 72 to affect the electric field at two off-center locations along each channel section. The fingers 70, 72 can thus cause the plasma arc discharge to spread, rather than concentrate at the center of the channel 56. The uniformity of light emitted by the lamp 40 will be improved correspondingly.

In some applications, it is desirable to further modify the electric field within the chamber 52 by applying a voltage between the resistive trace 82 and one or both of the cover electrodes 64, 66. To provide this voltage, second and third power supplies 89, 91 (FIG. 3) are connected between the third terminal 88 and the terminals 78, 80 on the cover 50. The voltage differences between the cover electrodes 64, 66 and the resistive trace 82 form respective electric fields between the cover electrodes 64, 66 and the resistive trace 82.

Figure 4:
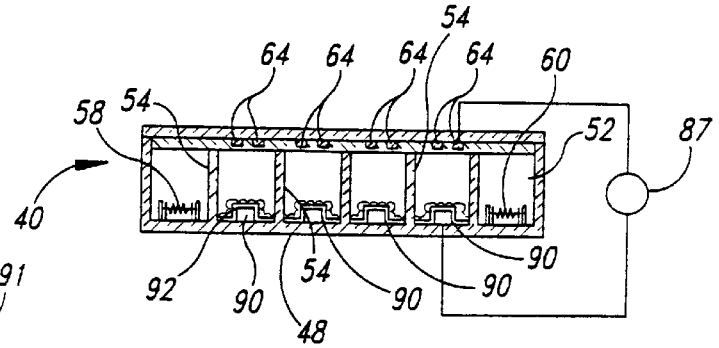
FIG. 4 is a side cross-sectional view of an alternative embodiment of the lamp having an optically transmissive cover electrode bonded to a lower surface of the lamp cover and a resistive heating element within the lamp chamber.
Figure 5:
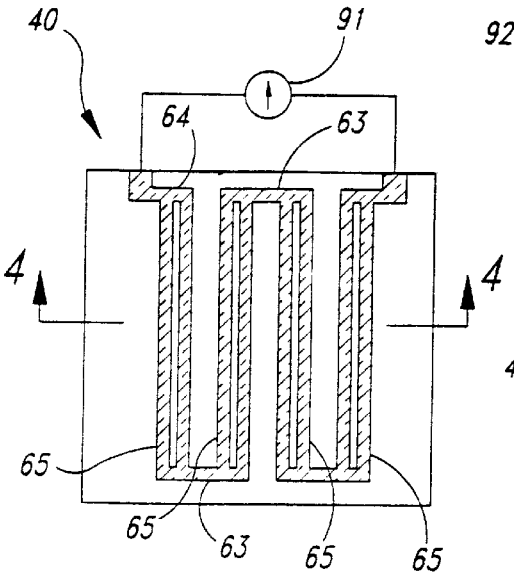
FIG. 5 is a top plan view of the lamp of FIG. 4 showing the bifurcated structure of the cover electrodes.

In an alternative structure for controlling the electric fields between the cover 50 and the base 48, the resistive trace 82 may be replaced or supplemented by an interior base electrode 90, as shown in the embodiment in FIGS. 4 and 5. Once again, the thickness of the layers, such as the interior base electrode 90, are shown to exaggerated scale for clarity of presentation. Also, the interior structure of the lamp 40 is omitted from FIG. 5 so that the structure of the cover electrode 64 will be more clearly visible. When a voltage from the power supply 87 is applied between the cover electrode 64 and the interior base electrode 90, an electric field is produced within the chamber 52, as described above for cover electrodes 64, 66 and the resistive trace 82 of the lamp 40 of FIGS. 1, 2, and 3. Because only a single cover electrode 64 is used in the lamp 40 of FIG. 4, only the single power supply 87 is necessary to produce an electric field between the cover electrode 64 and the interior base electrode 90.

The interior base electrode 90 is preferably a thick film aluminum patterned by masking or photolithography, as such processing is effective, well-known, and inexpensive. Alternatively, a thin film conductive material may be used, such as a deposited aluminum or a silver alloy. Other materials and fabrication techniques may also be used for the interior base electrode 90. For example, other conductive or resistive materials, including transparent conductors such as indium tin oxide, may be used.

A lower insulative layer 92 overlays the interior base electrode 90 to provide an insulative barrier between the interior base electrode 90 and the chamber 52. The lower insulative layer 92 is preferably a transparent insulative material, such as a deposited glass, to take advantage of the reflectivity of the thick film aluminum. If material having a low reflectivity is used for the interior base electrode 90, the lower insulative layer 92 would preferably be a white or reflective opaque material.

Also visible in FIG. 5 is a serpentine, bifurcated structure for the cover electrode 64. In this structure, each leg 65 of the cover electrode 64 is a bifurcated conductor connected to an adjacent leg through an edge trace 63 such that the cover electrode 64 forms a continuous serpentine structure.

Because the cover electrode 64 is a continuous structure, current supplied by a current source 91 flows though the cover electrode 64, causing resistive heating. The bifurcated structure of the legs 65 causes the legs 65 to produce heat at the edges of the serpentine channel 56, near the channel walls 54, rather than just in the center of the serpentine channel 56. This helps to reduce condensation of the mercury vapor at the channel walls 54. Further, the bifurcated leg structure causes the electric field between the cover electrode 65 and the interior base electrode 90 to be distributed evenly through the chamber 52 and causes the electric plasma discharge to spread, broadening the area from which light is produced. This, in turn, increases the uniformity of light produced by the lamp.

Where cost, efficiency, or other concerns dictate, the resistive trace 82 may be used without the cover electrodes 64, 66. In this embodiment, shown in FIG. 6, the resistive trace is a serpentine trace on the lower surface of the base 48, similar to the resistive trace 82 of FIG. 3, and the lamp 40 is heated by passing a current through the resistive trace 82 as described with respect to FIG. 3. Additionally, a voltage provided by a voltage source 95 is applied to the resistive trace 82 and referenced to one or both of the electrodes 58, 60 to generate an electric field within the chamber 52.

Figure 6:
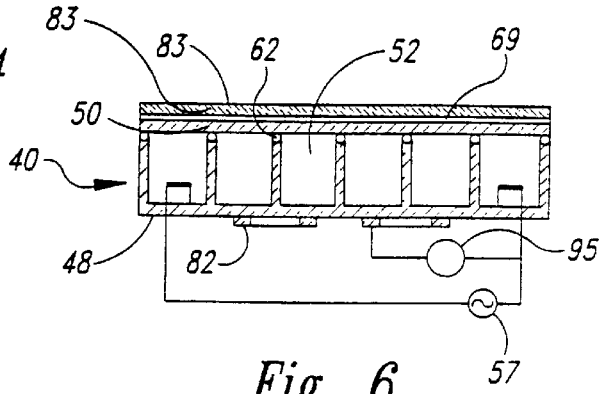
FIG. 6 is a side cross-sectional view of an alternative embodiment of a lamp having a resistive heating element bonded to the exterior surface of the base and dual lamp covers.

Also visible in FIG. 6 is an alternative structure in which the fluorescent material 69 is exterior to the chamber 52. In this embodiment, a secondary cover 83 overlays the cover 50 with the fluorescent material 69 sandwiched between the secondary cover 83 and the cover 50. During operation of the lamp 40, the ultraviolet energy produced by the mercury vapor in response to the electrical discharge passes though the cover 50 and strikes the fluorescent material 69. In response, the fluorescent material 69 emits visible light through the secondary cover 83 towards an observer. This embodiment advantageously separates the fluorescent material 69 from the interior of the chamber 52 to prevent migration of phosphor ions from the fluorescent material 69 into the insulative materials, such as the glass solder bead 62. This prevents the phosphor from providing a conductive path through the insulative material reducing its insulative effectiveness. This dual cover structure can also be used with the cover electrodes 64, 66, 98, 100, 102, 104, 108, 112 described with respect to the various other embodiments. In such embodiments, removal of the fluorescent material 69 from the chamber 52 reduces phosphor migration into the insulative coating 68 overlaying the electrodes 64, 66.

Figure 7:
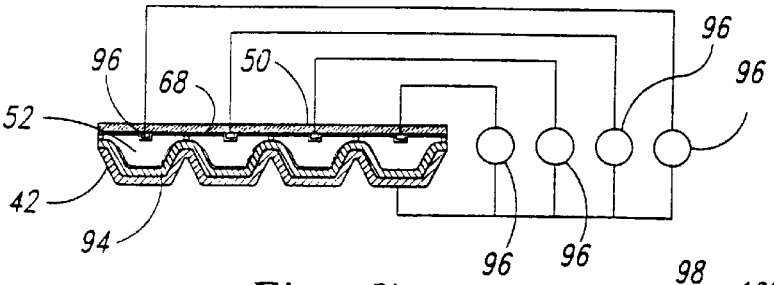
FIG. 7 is an alternative embodiment of the invention having a metal lamp body.
Figure 8:
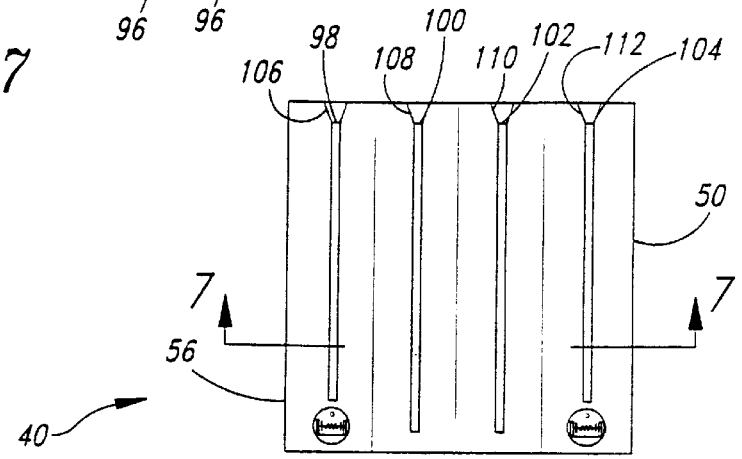
FIG. 8 is a top plan view of the lamp of FIG. 7 showing a segmented cover electrode.

As shown in FIGS. 7 and 8, the lamp body 42 may be made of metal with an insulative coating providing electrical insulation between the lamp body 42 and the chamber 52. The fabrication of such lamps is described in co-pending application Ser. No. 08/198,495, now U.S. Pat. No. 5,479,069, which is incorporated herein by reference. In this embodiment, discrete cover electrodes 98, 100, 102, 104 of an optically transmissive conductive material are formed on an inner surface of the cover 50. As before, the transparent insulative coating 68 overlays the cover electrodes 98, 100, 102, 104.

Though this embodiment is shown with several cover electrodes 98, 100, 102, 104, it can be seen that the electrode structure of FIG. 5 having dual cover electrodes may also be employed. Similarly, a resistive trace similar to the resistive trace 82 of the lamp 40 of FIGS. 1–3 may be bonded to the lamp body 42 to provide heat to the lamp 40. In such an embodiment, the insulative coating 94 would be extended to cover the lower surface of the lamp body 42 to provide electrical insulation between the resistive trace and the lamp body 42.

Operation of this embodiment is substantially similar to the operation of previous embodiments. However, in this embodiment, an electric field can be generated between the cover 50 and the lamp body 42 by connecting a voltage between the cover electrodes 98, 100, 102, 104 and the metal lamp body 42 through gaps in the insulative coating 94.

Each of the cover electrodes 98, 100, 102, 104 may be utilized as an individual, distinct electrode. To control the electric fields, a separate voltage is applied to each of the electrodes 98, 100, 102, 104 to generate electric fields in each of the sections of the serpentine channel 56 independently. To enable each of the segments 98, 100, 102, 104 to be independently controlled, each of the segments 98, 100, 102, 104 includes a respective terminal 106, 108, 110, 112 which is exposed at an edge of the cover 50. The metal lamp body 42 thus acts as a base electrode. Because the metal lamp body 42 forms an extended electrode, it is preferred that the cover electrode 96 be narrow, such that the electric fields are concentrated near the center of the channels.

In this embodiment, the voltage potential between the individual segments 98, 100, 102, 104 and the lamp body 42 may be varied by connecting separate power supplies 96 between the cover electrodes 98, 100, 102, 104 and the lamp body 42. With this connection, the voltage potential between adjacent segments, e.g., segment 100 and segment 102 may be varied as well. This permits the electrical fields within the chamber 52 to be controlled on a segment-by-segment basis, so that the light energy can be affected differently in different segments. Such a structure is particularly advantageous in allowing the segments most remote from the electrodes 58, 60 (in this case, segments 100, 102) to be affected most significantly to improve light emission in the center of the lamp 40 during low light operation.

While the segmented electrode structure of FIGS. 7 and 8 is shown and described with respect to the metal lamp body 42, it can be seen that the segmented electrode structure can also be used with an insulative lamp body, either with or without an electrode or resistive trace oil the lamp body 42. Additionally, where an electrode, such as the interior base electrode 90 of the embodiment of FIGS. 4 and 5, or a resistive trace, such as the resistive trace 82 of the embodiment of FIGS. 1–3, is supported by the base 48, the electrode or resistive trace may be segmented to provide further flexibility in controlling the electric fields or heat generation along various portions of the discharge path.

Figure 9:
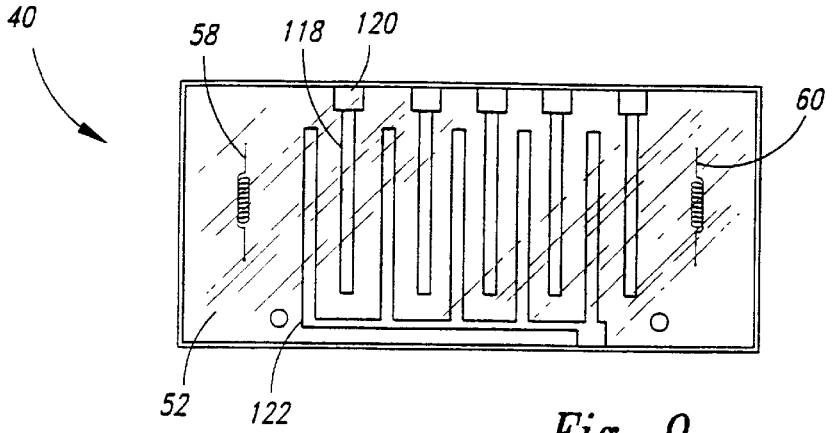
FIG. 9 is an alternative embodiment of a planar lamp with interdigitated cover electrodes and a linear discharge path.

Although the embodiments described above have employed channel walls 54 to define a serpentine channel 56, it will be appreciated that the use of electrodes and resistive heaters supported by the base 48 and cover 50 may be employed on a lamp 40 having a linear or other discharge path. For example, in the linear discharge lamp 40 of FIGS. 9 and 10, the electrodes 58, 60 are at opposite ends of a single rectangular chamber 52. A plurality of optically transmissive cover electrodes 118, each having a respective terminal 120, are aligned to portions of a reference cover electrode 122 to form an interdigitated structure. The electrodes 118, 122 are positioned transversely to the discharge path at spaced-apart locations between the electrodes 58, 60, to permit the electric field to be varied discretely along the discharge path. While the electrodes 118, 122 of the lamp 40 of FIGS. 9 and 10 are shown as intersecting the discharge path perpendicularly, electrodes 118, 122 parallel to the discharge path, such as those shown in FIGS. 1 and 8, are also within the scope of the invention.

Figure 10:
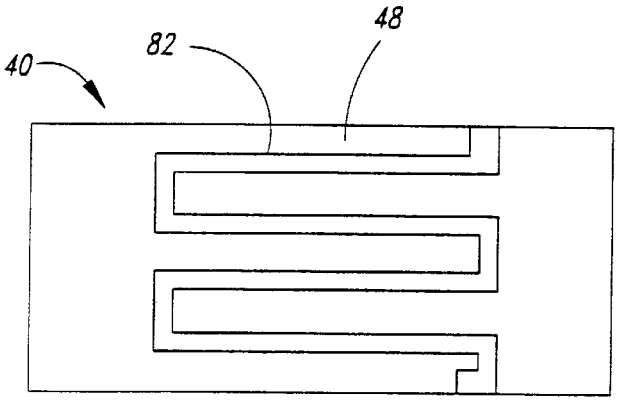
FIG. 10 is a bottom plan view of the lamp of FIG. 9 showing a serpentine resistive trace on the lower surface of the lamp.

As seen in the bottom view of FIG. 10, the lamp 40 also includes a resistive trace 82 on the base 48. As before, the resistive trace 82 can be used to heat the lamp 40 and may also be used as a base electrode in conjunction with one or more of the electrodes 118, 122 to control the electric fields within the lamp.

Figure 11:
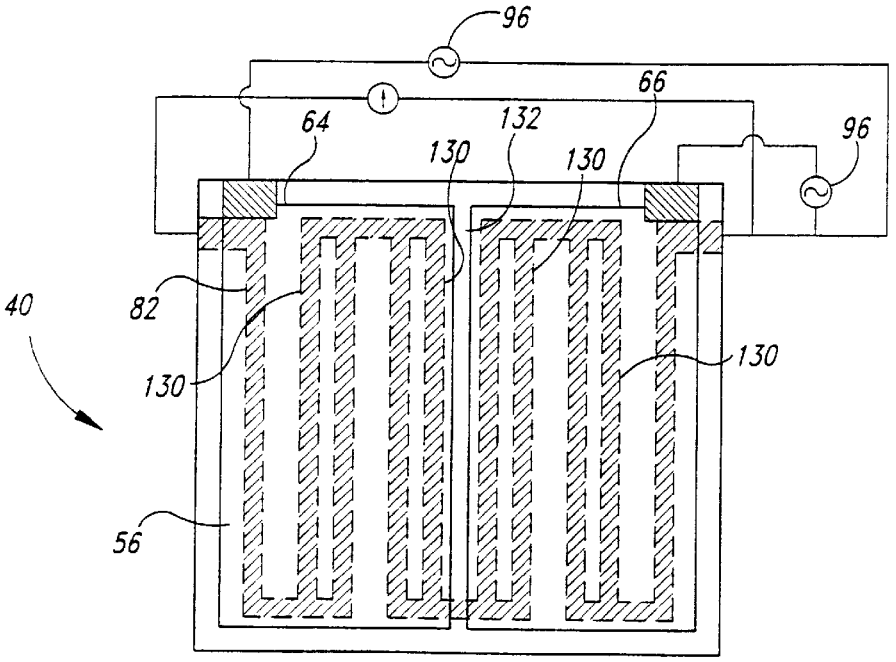
FIG. 11 is a top plan view of a lamp having a serpentine resistive trace with bifurcated segments and two rectangular, optically transmissive cover electrodes.

In the embodiment shown in FIG. 11, the resistive trace 82 (shown in broken lines) is formed from linked bifurcated legs 130 on the lower surface of the lamp 40. The cover electrodes 64, 66 are planar sheets covering approximately half of the serpentine channel 56, with a narrow gap 132 separating the cover electrodes 64, 66.

The lamp 40 is heated by providing current to the resistive trace 82 with the current source 91. As with the cover electrode 64 of FIG. 5, the bifurcated structure of the resistive trace 82 distributes heat near the channel walls 54 to reduce condensation.

Voltage between the respective cover electrodes 64, 66 and the resistive trace 82 is generated by a pair of power supplies 96, such that electric fields are produced between the cover electrodes 64, 66 and the resistive trace 82.

From the foregoing, it will be appreciated that, although embodiments of the invention have been described herein for purposes of illustration, various modifications may be made without deviating from the spirit and scope of the invention. Accordingly, the invention is not limited except as by the appended claims.

What is claimed is:

1. A planar fluorescent lamp comprising:

a lamp body having a base and sidewalls, the base having an exterior surface;

a lamp cover supported by the lamp body, the base, sidewalls and lamp cover defining a chamber with the exterior surface of the base being electrically isolated from the chamber;

a first electrode within the chamber;

a second electrode within the chamber and spaced apart from the first electrode, the first and second electrodes forming energy inputs for providing an electrical discharge along a discharge path between the first electrode and the second electrode;

an elongated first resistive heating element supported by the base and in thermal contact with a first portion of the chamber for providing heat to the first portion;

a pair of heating energy input terminals electrically connected to the first heating element for providing electrical energy to heat the first heating element; and a second heating element supported by the lamp cover for supplying heat to the first portion of the chamber, wherein the second heating element includes:

a first transparent electrically conductive film supported by the cover; and a layer of insulative material overlaying the first transparent electrically conductive film and providing an insulative barrier between the chamber and the first transparent electrically conductive film.

2. The planar fluorescent lamp of claim 1 wherein the first heating element includes a resistive film bonded to the exterior surface of the base.

3. The planar fluorescent lamp of claim 1, further comprising a third heating element supported by the base for supplying heat to a second portion of the chamber.

4. The lamp of claim 1 wherein the first transparent electrically conductive film is positioned to produce an electric field along the discharge path.

5. The lamp of claim 4 wherein the first transparent electrically conductive film is formed into a bifurcated structure.

6. The lamp of claim 4, further including a second transparent conductive film supported by the cover and separated from the first transparent conductive film to form a gap therebetween, wherein the layer of insulative material provides an insulative barrier between the chamber and the second transparent conductive film;

a first terminal for electrical connection to the first transparent conductive film; and a second terminal for connection to the second transparent conductive film.

7. The lamp of claim 1 wherein the lamp body comprises a metal housing, further including an insulative coating overlapping the housing to insulate the housing from the chamber and the resistive heating element.

8. A planar fluorescent lamp, comprising:

an insulative lamp body having a base and a plurality of sidewalls connected to the base;

a lamp cover attached to the lamp body, the lamp cover and lamp body defining a chamber;

a plurality of channel walls within the chamber, the channel walls projecting from the base toward the lamp cover, the channel walls, sidewalls, base and lamp cover defining a serpentine channel;

a serpentine resistive trace supported by the base and in thermal contact with the base, a portion of the resistive trace paralleling the serpentine channel, the resistive trace producing heat in response to an electrical current passing therethrough, the trace being electrically insulated from the chamber;

a gas within the chamber, the gas producing ultraviolet energy in response to electrical stimulation; and a plurality of electrodes within the chamber for providing the electrical stimulation.

9. The planar fluorescent lamp of claim 8, further including:

a terminal connected to the resistive trace for providing to the resistive trace a voltage relative to an electric potential at a location within the chamber to produce an electric field within the chamber.

10. The planar fluorescent lamp of claim 8 wherein the resistive trace is within the chamber, further including:

a layer of insulative material overlaying the resistive trace and providing an insulative barrier between the chamber and the resistive trace.

11. The planar fluorescent lamp of claim 8 wherein the resistive trace is exterior to the chamber.

12. The planar fluorescent lamp of claim 8, further including:

a secondary cover overlaying the lamp cover; and a fluorescent material intermediate the lamp cover and the secondary lamp cover.

13. The planar fluorescent lamp of claim 8, further including an electrically conductive, optically transmissive electrode supported by the cover.

14. The lamp of claim 13 wherein the transparent electrically conductive film is formed into a bifurcated structure.

15. The planar fluorescent lamp of claim 13, further including a first terminal electrically connected to the optically transmissive electrode for electrical connection to a first output terminal of a voltage supply; and a second terminal electrically connected to the resistive trace for electrical connection to a second output terminal of the voltage supply.

16. A planar fluorescent lamp, comprising:

a lamp body having a base and a plurality of sidewalls connected to the base;

a lamp cover attached to the lamp body, the lamp cover and lamp body defining a chamber;

a plurality of channel walls within the chamber, the channel walls projecting from the base toward the lamp cover, the channel walls, sidewalls, base and lamp cover defining a serpentine channel;

an electrically conductive first trace supported by the base, a portion of the first trace parallel to the serpentine channel, the first trace being electrically insulated from the chamber;

an electrically conductive, optically transmissive second trace supported by the cover, a portion of the second trace parallel to the portion of the first trace, the second trace being electrically insulated from the chamber; and a gas within the chamber, the gas producing ultraviolet energy in response to electrical stimulation.

17. The fluorescent lamp of claim 16 wherein the first trace is attached to an exterior surface of the lamp body.

18. The fluorescent lamp of claim 16 wherein the first trace is within the chamber, further including:

an electrically insulative layer overlaying the first trace to electrically insulate the first trace from the chamber.

19. The fluorescent lamp of claim 18 wherein the electrically insulative layer overlaying the first trace is an optically reflective layer.

20. The fluorescent lamp of claim 16, further including a first terminal electrically connected to the first trace for connection to a first voltage and a second terminal electrically connected to the second trace for connection to a second voltage different from the first voltage, the second electrode being positioned relative to the first electrode to produce an electric field within the chamber and having a selected orientation and having when the first and second voltage are applied.

21. The fluorescent lamp of claim 20 wherein the first trace includes a resistive segment in thermal contact with the chamber, further including a third terminal electrically connected to the first trace for supplying a current to the first trace to provide heat to the chamber.

22. The fluorescent lamp of claim 16 wherein the second trace includes an indium tin oxide layer.

23. The lamp of claim 16 wherein the lamp body comprises a metal housing, further including an insulative coating overlapping the housing to insulate the housing from the chamber and the resistive heating element.

24. A planar fluorescent lamp, comprising:

an insulative lamp body having a base and a plurality of sidewalls connected to the base;

a lamp cover attached at its lower surface to the lamp body, the cover and lamp body defining a chamber;

a first electrode within the chamber;

a second electrode within the chamber and spaced apart from the first electrode to provide a discharge path between the first and second electrodes;

a plurality of electrically conductive, optically transmissive traces supported by the cover, a first one of the traces having a first terminal for connection to a first voltage and a second one of the traces having a second terminal for connection to a second voltage, the first and second traces being oriented to generate an electric field within the chamber, the electric field intersecting the discharge path; and a gas within the chamber, the gas producing ultraviolet energy in response to an electrical discharge along the discharge path.

25. The fluorescent lamp of claim 24 wherein the first and second traces are within the chamber, further including an optically transmissive insulative layer providing an insulative barrier between the traces and the remainder of the chamber.

26. The fluorescent lamp of claim 24 wherein the optically transmissive insulative layer is a titanium oxide thin film layer.

27. The fluorescent lamp of claim 24, further including a third electrically conductive, optically transmissive trace supported by the cover, wherein a portion of the second trace is positioned intermediate a portion of the first trace and a portion of the third trace.

28. The fluorescent lamp of claim 27, further including a conductive first buss along a first edge of the cover electrically connected to the first trace and the third trace, the buss being electrically isolated from the second trace.

29. The fluorescent lamp of claim 28, further including a conductive second buss along a second edge of the cover electrically connected to the second trace, the second buss being electrically isolated from the first and third buss.

* * * * *